US005782105A

United States Patent [19]

Stork

[11] Patent Number: 5,782,105

[45] Date of Patent: Jul. 21, 1998

[54] KITCHEN APPLIANCE FOR INSTALLATION IN CAMPING VEHICLES IN PARTICULAR

[75] Inventor: Sven Stork, Oberbüren, Switzerland

[73] Assignee: Electrolux Siegen GmbH, Siegen, United Kingdom

[21] Appl. No.: 800,234

[22] Filed: Feb. 12, 1997

[30] Foreign Application Priority Data

Feb. 14, 1996 [DE] Germany ..... 196 05 473.7

[51] Int. Cl.[6] ..... F25D 15/00; F24C 1/14; A47B 81/00

[52] U.S. Cl. ..... 62/331; 63/476; 126/24; 126/215; 312/236; 312/317.2

[58] Field of Search ..... 62/331, 476, 244, 62/485; 126/24–4, 56, 215–216, 85 B; 312/140.2, 140.3, 201, 236–270.1, 317.2–317.3

[56] References Cited

U.S. PATENT DOCUMENTS

| | | | |
|---|---|---|---|
| 3,627,396 | 12/1971 | Miller | 312/229 |
| 3,668,889 | 6/1972 | Magnusson et al. | 62/476 |
| 3,680,541 | 8/1972 | Honaker | 126/85 B |
| 3,823,992 | 7/1974 | Corbett | 312/201 |
| 5,029,935 | 7/1991 | Dufrancatel | 296/156 |
| 5,355,693 | 10/1994 | McConnell et al. | 62/244 |
| 5,586,546 | 12/1996 | Ashcraft et al. | 126/42 |

FOREIGN PATENT DOCUMENTS

| | | | |
|---|---|---|---|
| 373397 | 6/1990 | European Pat. Off. . | |
| 942405 | 7/1964 | France | 62/331 |
| 685362 | 12/1939 | Germany | 62/331 |
| 26 05 760 | 8/1977 | Germany . | |
| 26 17 941 | 8/1983 | Germany . | |
| 33 30 037 | 3/1984 | Germany . | |
| 36 34 010 | 4/1987 | Germany . | |
| 33 13 743 | 10/1987 | Germany . | |
| 88 04 253 | 7/1988 | Germany . | |
| 91 07 815 | 10/1991 | Germany . | |
| 44 43 994 | 4/1995 | Germany . | |

OTHER PUBLICATIONS

Yacht Aug. 1989, May 1989, pp. 158–160.

*Primary Examiner*—William Doerrler
*Attorney, Agent, or Firm*—Pearne, Gordon McCoy and Granger LLP

[57] ABSTRACT

In a kitchen appliance including a refrigerator and a cooker 7 and being intended and suitable for installation in camping vehicles, boats and the like, the cooker 7 is fixedly mounted on the upper side of the refrigerator including at least one gas burner 8 and the relating fittings 12, while the cover plate 13 of the cooker 7 can be assembled and disassembled. The burner 8 and the thermosensors 26 of the cooker 7 are movable in height in limited manner for bearing on a relating opening in the cover plate 13 from bottom and for being connected or screwed, respectively, to a burner head to be put thereon from top. The construction permits simple and quick installation and removal of the refrigerator together with the cooker 7.

16 Claims, 3 Drawing Sheets

KITCHEN APPLIANCE FOR INSTALLATION IN CAMPING VEHICLES IN PARTICULAR

BACKGROUND OF THE INVENTION

The invention relates to a kitchen appliance including at least a refrigerator and a stove, suited for installation in camping vehicles like trailers and other travel vehicles. A further preferred field of use are leisure boats, like motor and sailing yachts.

A refrigerator intended for this purpose usually has a front door through which the cooling compartment is accessible as well as a cooling unit arranged on the backside, usually an absorber unit which can be operated by a gas burner. In camping vehicles removal of the heat generated by the absorber unit is effected by aeration slots formed in the outside wall and/or the roof of the vehicle and permitting convection of the outside air. In boats the refrigerating unit is cooled by converging inside air. The service and surveillance members are arranged on a suitable place on the front face of the refrigerator.

Camping vehicles and boats are equipped with an interior equipment which offers the possibility of installing a refrigerator of the above-explained kind and of a stove. In most cases therein the stove is installed on top of the refrigerator and a larder located beside the refrigerator accomodates a sink in its open top side. The refrigerator and the stove therein often originate from different manufacturers and are not mutually coordinated. Due to the cramped room conditions this mostly results in that for a removal of the refrigerator, e.g. for maintenance or cleaning of the cooling unit, at first the stove has to be disassembled, if necessary together with the sink. Moreover, because of the missing identity in dimensions often the existing room for installation can be utilized optimally. Finally, separate supply lines for the various units have to be provided for which each have to be equipped with separately operable blocking means.

SUMMARY OF THE INVENTION

The invention is based on the object of realizing a kitchen appliance of the kind cited in the beginning such that the lowest possible installation work is required for its installation into and removal from a given equipment and that the installation room for the refrigerator and a stove correlated thereto is utilized optimally as well as that energy supply elements are optimized.

This object is achieved by the present invention such that on the upper side of the refrigerator a stove including at least a gas burner and the relating fittings is mounted fixedly, that the cover plate of the stove can be assembled and/or disassembled, respectively, independently from the other parts of the stove and that the burner and/or burners, respectively, is (are) movable in height in limited manner in order to bear on a realting opening in the cover plate from bottom and to be connected to a burner head put thereon from top.

The refrigerator thus forms a constructional unit with the stove, which as total is mounted in the existing installation room. Only the cover plate is fixed to the built-in furniture of the vehicle. A connection between the cover plate and to stove only exists on the burners which from bottom reach into the openings of the cover plate and from top are connected to the burner heads. For removing the refrigerator, it will be sufficient to detach the burner from the burner heads and to fold it away downwardly and to pull out the refrigerator out of the opening to the front upon loosening of the screws on the kitchen furniture panelling.

Thus, for easy separation of the stove from the cover plate, the connection between each burner and the relating burner head is built in form of a quick-seal coupling.

The combination of the refrigerator and the stove provides the additional advantage that the service and surveillance elements for the stove as well as for the refrigerator can be combined. Preferably, they are arranged in a panel on the front side of the stove.

A further advantage lies in that in contrast to the known constructions no separate gas lines are required any more for the stove and the refrigerator. Rather a common gas connection to the gas supply of the vehicle with a subdivision for the burners and the refrigerator will be sufficient, said branching preferably being located within the appliance in the area of the stove. The common gas line can be blocked by one single gas blocking means.

BRIEF DESCRIPTION OF THE DRAWINGS

These and further features of the present invention will be apparent with reference to the following detailed description and drawings, wherein.

DETAILED DESCRIPTION OF THE PREFERRED EMBODIMENT

Figure 1:
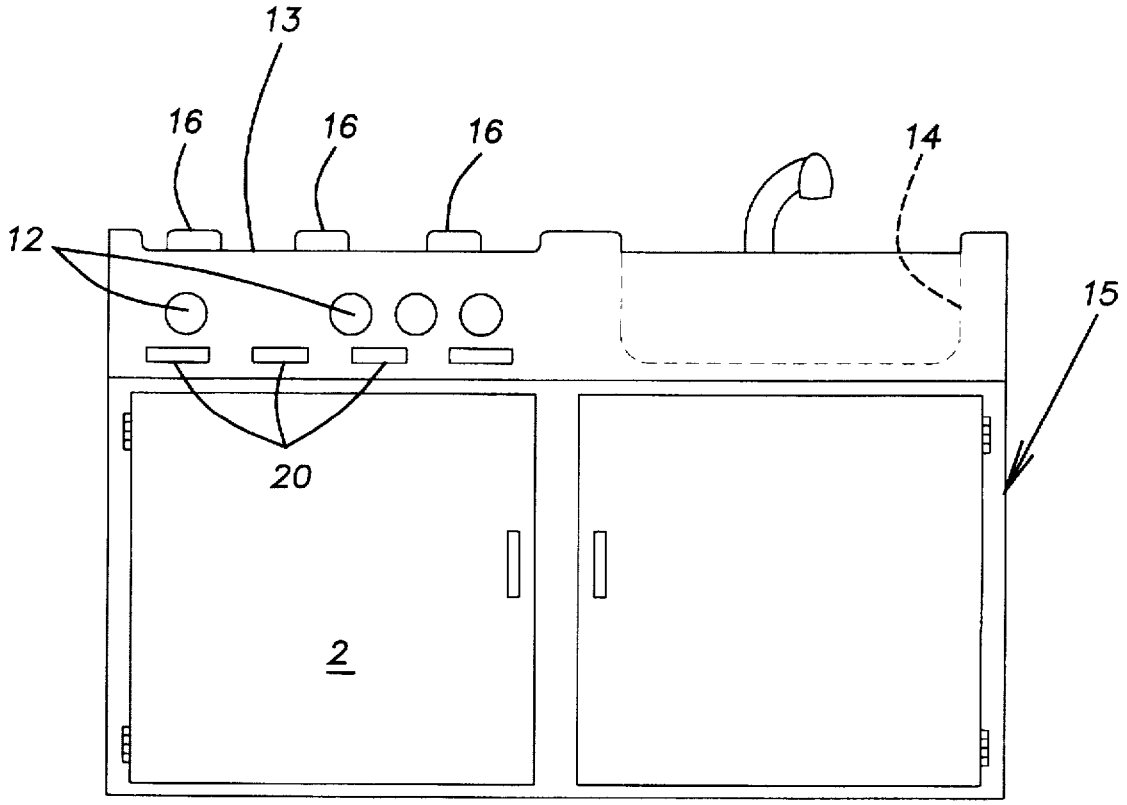
FIG. 1 shows a front view of a refrigerator with a stove on its upper side, installed in a vehicle.
Figure 2:
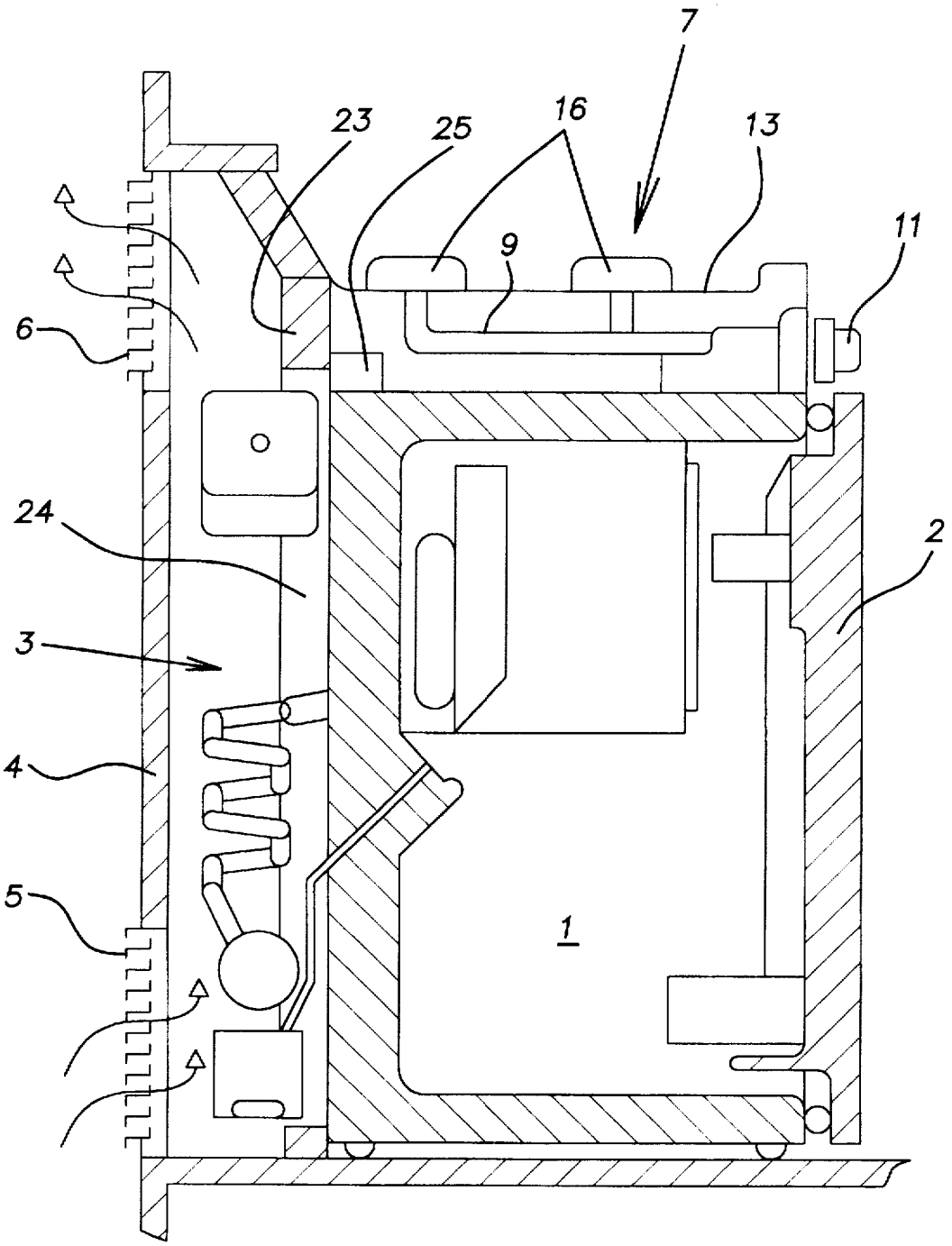
FIG. 2 shows a vertical section through FIG. 1.

The kitchen appliance in accordance with the present invention comprises a refrigerator having an inner room 1 for accomodating the goods to be kept cool, a door 2 on the front side and an absorber unit 3 on the rear side. In assembled condition the absorber unit is located with small distance to the outside wall 4 of the vehicle. Two groups 5 and 6 arranged one on top of the other, of air gaps in the outside wall 4 permit convection of external air for dissipating the heat produced by the absorber unit.

On the top side of the refrigerator a gas stove 7 is fixedly installed, which stove in the shown embodiment has three burners 8. Each burner 8 is located on one end of an injector or mixing pipe 9 whose other end is put on an injector 10 for adjustable supply of a gas/air mixture. The injector 10 together with the injector pipe 9 therein is pivotable in limited manner about a horizontal axis so that the burner can be tilted in upward and downward directions.

A service panel accomodating the locks 11 for regulation of the individual burners 6 as well as the service and display elements 12 for the refrigerator is located on the frontside of the stove.

In assembled condition of the stove 7 combined with the refrigerator this one is located below a cover plate 13 covering all parts of the stove except for the burner heads 16. Circular orifices are provided for the burners 8.

The cover plate 13 is fixedly mounted on the built-in parts of the vehicle and cannot be removed without problems. In the shown embodiment it is formed in one piece with the sink 14 accomodated by the upper portion of a built-in cupboard 15 located beside the refrigerator. The cover plate 13, however, can only cover the installation field intended for the refrigerator and the stove.

A burner head 16 having exit openings for the gas flame belongs to every burner 8. The connection of a burner with relating burner head 16 is effected by means of a quick-seal coupling.

As already mentioned, the cover plate 13, maybe including the sink correlated thereto, is fixedly mounted on the built-in parts of the vehicle. Prior to installation of the refrigerator in the installation space provided therefor the burners 8 of the stove with the injection pipes 9 are tilted in downward direction. Therefore, the refrigerator including the stove mounted thereon can be pushed into the installation space without problems, the absorber unit 3 being sealed against the interior of the vehicle with suitable measurements.

Upon the refrigerator with the stove 7 having been pushed in, the burners 8 with the injection pipes 9 are tilted upwardly and, each burner 8 is connected to a burner head 16, if required, upon insertion of an O-shaped ring 17. For exact adjustment the stove can be mounted with its basic plate on the refrigerator in limitedly displaceable manner.

As a rule each burner 8 has a thermosensor 26 (not shown) in form of a thermomember whose tip protrudes into the flame. The thermomember is fixed beside the burner head 16 on the cover plate 13 by means of a screw. Alternatively, said thermomember can also be built as separate part having an own holding member held by the quick-seal coupling between the burner 8 and the burner head 16 on the bottom side of the cover plate 13 such that the tip of the sensor protrudes through an opening in the cover plate in upward direction. When loosening the connection between the burner and the burner head, also the hold becomes loose and the tip can be removed in downward direction from the cover plate.

Figure 3:
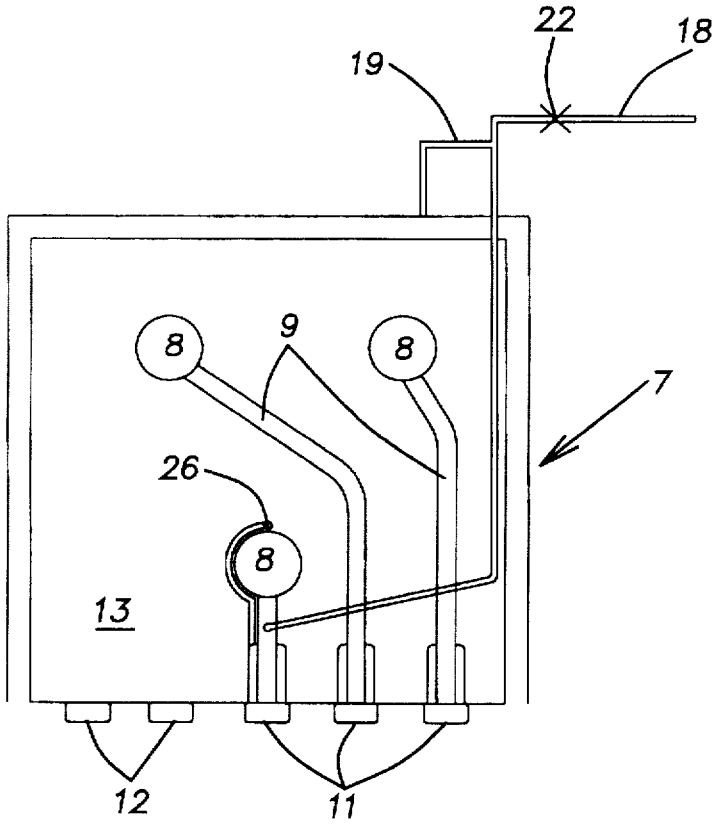
FIG. 3 shows a view from top onto the device combination without cover plate.
Figure 4:
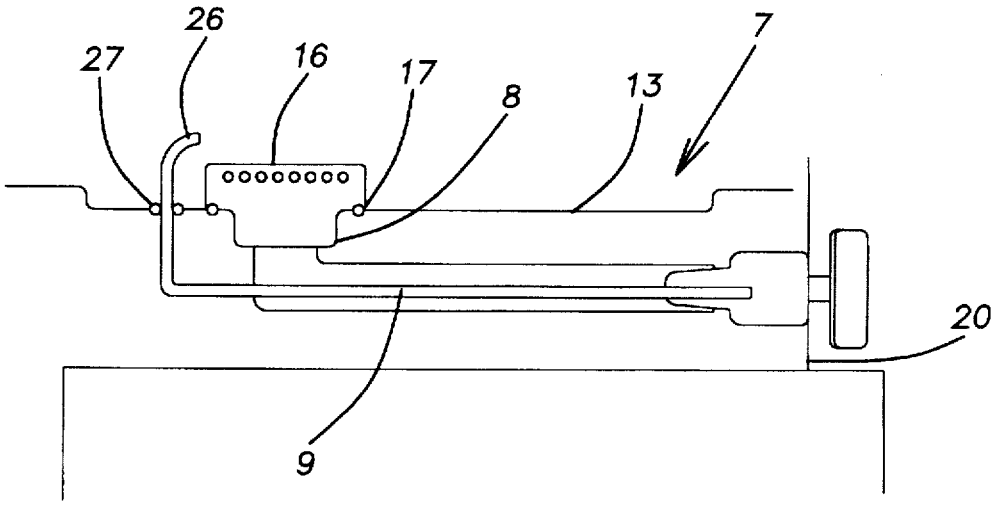
FIG. 4 shows a vertical section through the stove with burner fixed on the cover plate.

The unification of the refrigerator with the stove into an integrated structural unit permits a connection of these both units to one common gas connection. FIG. 3 shows a gas line 18 coming from a gas connection of the vehicle and having a branch 19 to the heating means of the refrigerating unit and to the burners 8 of the cooking areas. One single blocking cock is provided for the gas line 18.

Ventilation and cooling of the stove is effected by heat conduction over the surface of the cover plate 13 and by aeration and ventilation by one or several slots 20 in the region of the service panel.

As the stove and the refrigerator from a structural unit, the installation dimensions of the kitchen built-in cupboard 15 can be predetermined. Therein, the rearward cupboard wall 23 has a section 24 for accomodating the cooling unit 3. The section upon installation of the structural unit is completely closed by the refrigerator and an upper sealing band 25, so that no draught flow can occur in the camping vehicle through the air slots 5, 6.

As can be seen, the refrigerator with the stove arranged thereon, can be installed and removed without great expense and labour also by persons not very skilled.

What is claimed:

1. A kitchen appliance including at least a refrigerator and a stove, in particular for installation in camping vehicles, boats, and the like, said refrigerator defining a cooling compartment (1) accessible from a frontside thereof and closed by a door (2) and having a cooling unit (3) located on a backside thereof, wherein the stove (7) is fixedly mounted to an upper side of the refrigerator, said stove including at least one gas burner (8) and a cover plate (13), said stove cover plate (13) is adapted to be mounted and removed independently from remaining parts of the stove, and wherein said at least one gas burner is movable in height for bearing on a relating opening in the cover plate (13) from below and is connected with a burner head (16) put thereon from above.

2. An appliance as defined in claim 1, wherein said at least one gas burner (8) is fixedly connected to an injector pipe (9) which is connected to an adjustable gas supply.

3. An appliance as defined in claims 1 or 2, wherein a connection between said at least one gas burner (8) and the burner head (16) is a quick-seal coupling.

4. An appliance as defined in claims 1 or 2, wherein said at least one burner (8), for the purpose of flame surveillance, includes a sensor (26) in form of a thermomember, said sensor being fixed in a common hold with said at least one burner (8).

5. An appliance as defined in claim 4, wherein said sensor (16) is centered in an opening during attachment of the burner (8) on the cover plate (13).

6. An appliance as defined in claim 4, wherein an orifice for the sensor (26) in the cover plate (13) is sealed by a seal (27).

7. An appliance as defined in claim 1, wherein service and surveillance elements (11, 12) for the stove as well as for the refrigerator are arranged on a front face of the stove.

8. An appliance as defined in claim 1, wherein the cooling unit of the refrigerator is an absorber unit (3).

9. An appliance as defined in claim 1, wherein a common blockable gas connection (18) is provided, said connection including a plurality of branches for supply of said at least one burner and the cooling unit (3).

10. An appliance as defined in claim 1, wherein the cover plate (13) is fixed to a built-in furniture element comprising a space accessible from a front side to permit pushing the refrigerator with the cooker (7) below the cover plate (13).

11. An appliance as defined in claim 1, wherein said cover plate (13) has the same width and depth dimensions as the refrigerator to permit formation of a cooking trough.

12. An appliance as defined in claim 1, wherein said cover plate (13) comprises a part built as sink (14) and storage area which extends over the width dimensions of the refrigerator.

13. An appliance as defined in claim 1, wherein the cooling unit (3) of the refrigerator and the stove have separate vents.

14. An appliance as defined in claim 13, wherein, for aeration of the cooling unit, a camping vehicle has aeration slots (5, 6) which are formed in an external wall of the vehicle, said slots permitting convection of cooling air.

15. An appliance as defined in claims 13 or 14, wherein aeration and ventilation of the stove is effected by at least one opening (20) adjacent a service element.

16. An appliance as defined in claim 15, wherein aeration means (5,6;20) of the stove and the refrigerator are arranged in ventilation circuits which are shielded from one another.

* * * * *

UNITED STATES PATENT AND TRADEMARK OFFICE

CERTIFICATE OF CORRECTION

PATENT NO. : 5,782,105

DATED : July 21, 1998

INVENTOR(S) : Sven Stork

It is certified that error appears in the above-identified patent and that said Letters Patent is hereby corrected as shown below:

On the title page, Section [73] Assignee, delete "United Kingdom" and insert --Germany--.

On the title page, Other Publications, delete "Aug." and insert --Oct.--.

Signed and Sealed this

Twenty-seventh Day of October, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,782,105

DATED : July 21, 1998

INVENTOR(S) : Sven Stork

It is certified that error appears in the above-identified patent and that said Letters Patent is hereby corrected as shown below:

On the Title page, item [56], Other Publications should read as: --YACHT 10/89, 10 May 1989 Pgs. 158-160--.

Signed and Sealed this

Twenty-fourth Day of November, 1998

*Attest:*

*Attesting Officer*

BRUCE LEHMAN

*Commissioner of Patents and Trademarks*